US010479094B2

(12) United States Patent
Chen et al.

(10) Patent No.: US 10,479,094 B2
(45) Date of Patent: Nov. 19, 2019

(54) ENERGY EFFICIENT PRINTHEADS

(71) Applicant: Hewlett-Packard Development Company, L.P., Houston, TX (US)

(72) Inventors: Zhizhang Chen, Corvallis, OR (US); Mohammed Shaarawi, Corvallis, OR (US); Brian Bolf, Corvallis, OR (US); Paul Krause, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/765,255

(22) PCT Filed: Jan. 20, 2016

(86) PCT No.: PCT/US2016/014102

§ 371 (c)(1),
(2) Date: Mar. 31, 2018

(87) PCT Pub. No.: WO2017/127069

PCT Pub. Date: Jul. 27, 2017

(65) Prior Publication Data

US 2018/0281425 A1 Oct. 4, 2018

(51) Int. Cl.

| | |
|---|---|
| ***B41J 2/16*** | (2006.01) |
| ***B41J 2/175*** | (2006.01) |
| ***B41J 2/14*** | (2006.01) |
| ***B41J 2/335*** | (2006.01) |

(52) U.S. Cl.

CPC ..... *B41J 2/17503* (2013.01); *B41J 2/14129* (2013.01); *B41J 2/1603* (2013.01); *B41J 2/1642* (2013.01); *B41J 2/175* (2013.01); *B41J 2/33525* (2013.01); *B41J 2202/03* (2013.01)

(58) Field of Classification Search

CPC .. B41J 2/17503; B41J 2/14129; B41J 2/1642; B41J 2/1603; B41J 2/1628; B41J 2/1629; B41J 2/1631; B41J 2/1634

USPC ..... 347/20, 54, 63–65

See application file for complete search history.

(56) References Cited

U.S. PATENT DOCUMENTS

| | | | |
|---|---|---|---|
| 6,951,384 | B2 | 10/2005 | Anderson et al. |
| 7,025,894 | B2 | 4/2006 | Hess et al. |
| 7,517,060 | B2 | 4/2009 | Hess et al. |
| 2005/0157089 | A1 | 7/2005 | Bell et al. |
| 2013/0162724 | A1 | 6/2013 | Pugliese et al. |

(Continued)

FOREIGN PATENT DOCUMENTS

| | | |
|---|---|---|
| CN | 102947099 | 2/2013 |
| CN | 105163941 | 12/2015 |

(Continued)

OTHER PUBLICATIONS

Xuan, Y. et al., "Simplified Surface Preparation for GaAs Passivation Using Atomic Layer-Deposited High-k Dielectrics", Purdue University, Aug. 2007, 8 pages.

*Primary Examiner* — An H Do

(74) *Attorney, Agent, or Firm* — HP Inc. Patent Department

(57) ABSTRACT

Energy efficient printheads are disclosed. An example printhead includes a substrate with channels to direct ink toward a plurality of nozzles of the printhead. The example printhead further includes a passivation layer on the substrate. The passivation layer includes a first thin film of a first dielectric material formed using atomic layer deposition.

19 Claims, 6 Drawing Sheets

(56) References Cited

U.S. PATENT DOCUMENTS

| | | | |
|---|---|---|---|
| 2013/0298984 | A1 | 11/2013 | Kherani et al. |
| 2014/0264781 | A1 | 9/2014 | Feyh et al. |
| 2014/0340450 | A1 | 11/2014 | Kunnavakkam et al. |

FOREIGN PATENT DOCUMENTS

| | | |
|---|---|---|
| JP | 2012192629 | 10/2012 |
| WO | WO-2015147804 | 10/2015 |

ENERGY EFFICIENT PRINTHEADS

BACKGROUND

Ink-based imaging devices utilize ink to print images on media. Typically, inkjet printing devices include one or more printheads that have a plurality of nozzles to direct fluid (e.g., ink) onto a print medium to form an image. Thermal inkjet printing devices typically use an electrical pulse that heats the ink at a particular nozzle to form a bubble that causes the ink to be ejected out of the nozzle. As the ink cools and the bubble collapses, additional ink is drawn towards the nozzle in preparation for firing another ink droplet. Piezoelectric inkjet printing devices typically use an electrical pulse to flex a piezoelectric element to force ink through a corresponding nozzle. The thermal and/or mechanical stresses, as well as the interaction of chemicals involved during such printing processes can cause corrosion and/or wear on the printhead over time. Accordingly, printheads are typically fabricated with a passivation layer to offer some level of protection from these effects, thereby extending their reliability and useful life.

Figure 1:
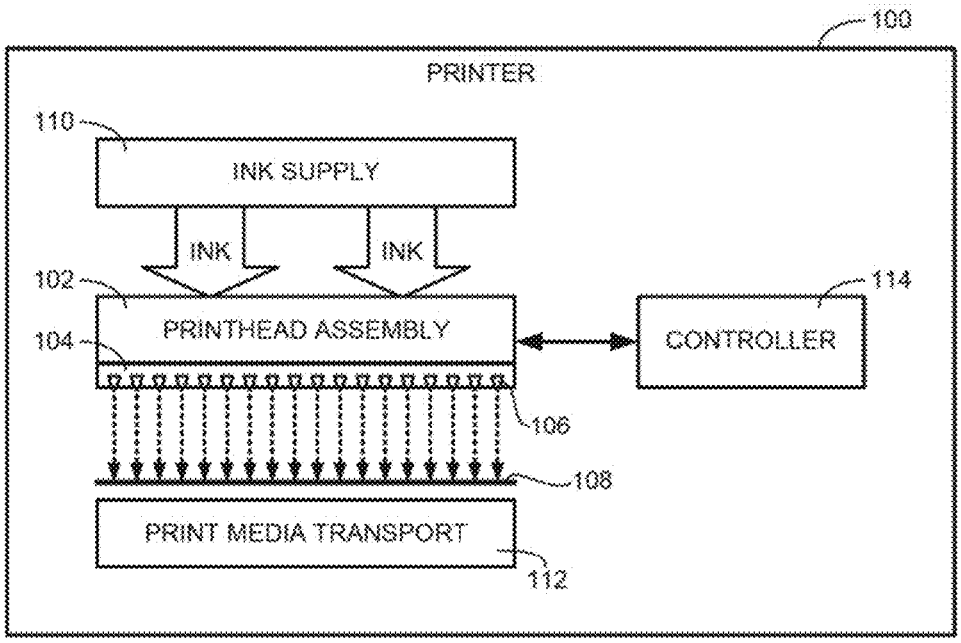
FIG. 1 is a block diagram illustrating an example inkjet printer in which the teachings of this disclosure may be implemented.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Typically, printheads for printers (sometimes referred to as printhead dies or simply dies) are coated with a passivation layer that includes a thin film stack having a chemically robust material to provide protection against exposure to chemicals and to reduce the impact of thermal and/or mechanical stresses involved in the printing process. Furthermore, a passivation layer typically includes a dielectric material to increase the energy efficiency of the printhead. In the past, passivation layers on printheads have been manufactured using plasma-enhanced chemical vapor deposition (PECVD) to form a film of silicon mononitride (SiN) followed by a film of silicon carbide (SIC). In such known passivation layers, the film of SiN is used because of its strong dielectric properties to support an applied voltage, while the SiC is used for its chemical robustness to protect the printhead from exposure to chemicals during the rest of the die fabrication process as well as during the printing process (e.g., chemicals in the ink).

While the passivation layer in printheads serves an important purpose of providing protection against the surrounding environment, the level of protection, in part, depends upon the thickness of the passivation layer. However, as the thickness of the passivation layer increases, the energy efficiency of the printhead may decrease. For example, in thermal inkjet printing applications, the passivation layer is typically applied over a heat resistor that is electrically actuated to fire ink through a corresponding nozzle in the printhead. A thicker passivation layer results in a reduction in heat transfer from the heat resistor to the ink, thereby resulting in losses in energy efficiency. Additionally, energy losses can result from electrical leakage from passivation layer materials that do not have strong dielectric properties. Accordingly, there is a desire to provide a passivation layer that is thinner to improve the efficiency of printheads but that also is robust to provide the same level of protection (or better) than other known printheads.

To meet design specifications, the known SiN/SiC passivation layer described above often has a total thickness of approximately 2500 angstroms (0.25 micrometers). The thickness of the individual thin film layers and the overall thickness of the passivation layer are driven by constraints dictated by the materials used and the method of depositing the films. For instance, although SiC provides robust chemical protection, it has relatively poor dielectric properties such that the SiN layer needs to be thicker than would be necessary if SiC had greater dielectric strength. Furthermore, the PECVD process provides relatively limited step coverage and can include pinhole defects giving rise to the need for relatively thick films to account for points of weakness where the film does not form as quickly. These factors contribute to an increased overall thickness and corresponding reduction in the efficiency of printheads.

The example printheads manufactured in accordance with the teachings of this disclosure include a passivation layer that is much thinner than other known passivation layers for printheads while providing a similar level of protection against corrosion and/or wear. Additionally, some example printheads disclosed herein use materials in the passivation layer with stronger dielectric properties than in other known passivation layers used in existing printheads. As a result, the example printheads with the passivation layer disclosed herein exhibit increased energy efficiency over currently known printheads. Further, the thinner passivation layers described herein enable the fabrication of printheads with a smaller footprint and/or with a higher nozzle density than previously possible. Additionally, the examples disclosed herein exhibit a substantial decrease in the turn-on energy enabling an increase in speed with which ink may be fired from a printhead nozzle, thereby increasing printing speed.

FIG. 1 is a block diagram illustrating an example inkjet printer 100 in which the teachings disclosed herein may be implemented. More particularly, the example printer 100 includes a printhead assembly 102 with an example printhead 104 that has a passivation layer fabricated using a new hybrid deposition technique that combines PECVD of a first thin film layer with atomic layer deposition (ALD) of a second thin film. As shown in the illustrated example, the printhead 104 has an array of nozzles 106 that eject ink droplets towards a print medium 108 (e.g., paper) in a pattern corresponding to a desired printed image. The example printer 100 also includes an ink supply 110, a print media transport mechanism 112, and a controller 114. In the illustrated example, the controller 114 represents generally the programming, processor(s) and associated memories, and the electronic circuitry and components needed to control the operative elements of the printer 100. In some examples, the printhead assembly 102 and the ink supply 110 are housed together as a single unit. In other examples, the printhead assembly 102 and the ink supply 110 are separate components. In some examples, the printhead assembly 102 is a stationary larger unit (with or without the ink supply 110) spanning the width of the print medium 108 (e.g., a page-wide print bar). Alternatively, in some examples, the printhead assembly 102 is a smaller unit that is scanned back and forth across the width of the print medium 108 on a moveable carriage (e.g., a scanning ink cartridge).

Figure 2:
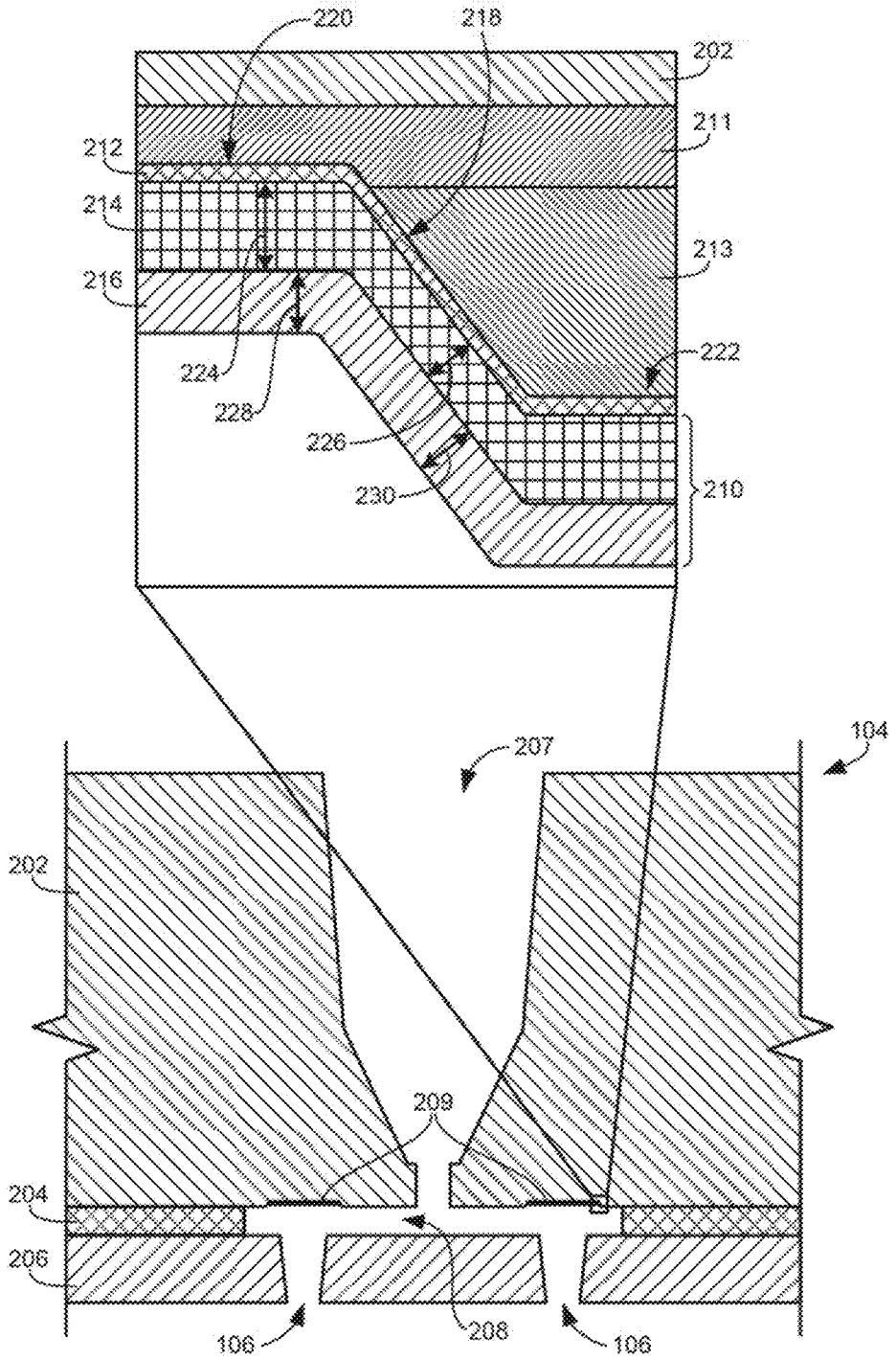
FIG. 2 is a cross-sectional side view of part of the example printhead of FIG. 1.

FIG. 2 is a cross-sectional view of part of the example printhead 104 of FIG. 1. In the illustrated example of FIG. 2, the printhead 104 includes a silicon substrate 202, a via structure layer 204, and a nozzle array layer 206. As shown in the illustrated example, the silicon substrate 202 includes an ink channel 207 that directs ink from the ink supply 110 (FIG. 1) into conduits or vias 208 defined by the via structure layer 204 and towards the nozzles 106 formed within the nozzle array layer 206. Although the via structure layer 204 is shown as a separate layer to the silicon substrate 202, in some examples, the via structure layer 204 may be integrally formed with the silicon substrate 202. In some examples, the via structure layer 204 is integrally formed with the nozzle array layer 206. In some examples, there may be one or more layers of other materials between any of the silicon substrate 202, the via structure layer 204, and/or the nozzle array layer 206.

As shown in the illustrated example, the nozzles 106 in the nozzle array layer 206 are aligned with ink ejection actuators 209 disposed on the silicon substrate 202 to activate the ejection of ink through the corresponding nozzles 106. In the illustrated example, the ink ejection actuator 209 is a heat resistor that heats the ink in the region of the nozzle 106 to force ink through the nozzle 106 in response to an electrical pulse generated by the controller 114 (FIG. 1).

The thermal stresses imposed by repeated heating and cooling of a printhead as well as the chemical and mechanical impacts of such a printing processes can have a deleterious effect on a printhead over time, thereby reducing its reliability. To reduce the impact of thermal, chemical, and/or mechanical stresses on the printhead 104, the surfaces of the silicon substrate 202, the via structure layer 204, and/or the nozzle array layer 206 undergo a passivation process to apply a protective coating that includes a stack of thin films to increase the robustness of surfaces of the printhead 104. For purposes of this disclosure, the protective coating is referred to herein as a passivation layer.

The illustrated example of FIG. 2 includes a close-up view illustrating an example passivation layer 210 formed on the surface of the silicon substrate 202. More particularly, as shown in the illustrated example, there are a number of layers formed on the silicon substrate 202 before the passivation layer 210 is applied. In some examples, the silicon substrate 202 carries a separate passivation layer 211 (e.g., formed of silicon dioxide ($SiO_2$)) to electrically isolate a heat resistive material 212 and an electrical conductor 213 from the silicon substrate 202. In the illustrated example, the heat resistive material 212 is used to form the ink ejection actuator 209 (e.g., a heat resistor) to heat and eject ink through the associated nozzle 106. In the illustrated example, the electrical conductor 213 (e.g., formed of aluminum copper (AlCu)) provides current to the ejection actuator 209 (e.g., a heat resistor formed of the heat resistive material 212). To protect the printhead 104, including the heat resistive material 212, from the stresses caused by the repeated energizing of the ejection actuator 209 and from interaction with chemicals in the ink, the example passivation layer 210 is disposed on the surface of the silicon substrate 202 over top of the heat resistive material 212 and other layers as shown in the illustrated example.

In FIG. 2, the example passivation layer 210 includes a stack of multiple thin films formed of dielectric materials. More particularly, in some examples, the passivation layer 210 includes a silicon mononitride (SiN) thin film 214 nearest the silicon substrate 202 and a hafnium oxide ($HfO_2$) thin film 216 disposed on the SiN thin film 214. As noted above, SiN is commonly used in passivation layers of known printheads because of its strong dielectric strengths. However, unlike other known passivation layers, the example passivation layer 210 of FIG. 2 includes a thin film of $HfO_2$ instead of SiC. Similar to SiC, $HfO_2$ is chemically robust and, therefore, serves as a good replacement for SiC. Furthermore, $HfO_2$ has stronger dielectric properties than SiC so as to provide greater energy efficiency than possible from known printheads using SiC as is described in greater detail below. While the illustrated example is described with respect to $HfO_2$, other materials may alternatively be used for the outer layer such as, for example, aluminum oxide ($Al_2O_3$), silicon dioxide ($SiO_2$), or tantalum oxide ($Ta_2O_5$). Furthermore, although only the two thin films 214, 216 are shown in FIG. 2, in other examples, the passivation layer 210 may include other thin film layers disposed on the silicon substrate 202 before (e.g., beneath) the SiN thin film 214, after (e.g., above) the $HfO_2$ thin film 216, and/or between the SiN thin film 214 and the $HfO_2$ thin film 216. For example, one or more thin film layers of tantalum (Ta), platinum (Pt), platinum iridium (Ptlr), or platinum ruthenium (PtRu) may be deposited on top of the $HfO_2$ thin film 216.

In some examples, the thin films 214, 216 are applied to the surface of the silicon substrate 202 using a hybrid passivation technique. More particularly, in some examples, the SiN thin film 214 is deposited onto the substrate 202 using plasma-enhanced chemical vapor deposition (PECVD) whereas the $HfO_2$ thin film 216 is deposited using atomic layer deposition (ALD). This hybrid deposition approach is distinct from traditional approaches to forming passivation layers on printheads that exclusively implement PECVD. That is, known passivation layers for printheads typically include a thin film of SiN deposited using PECVD similar to the example passivation layer 210 of FIG. 2 as described above. However, unlike the example passivation layer 210, known passivation layers for printheads are typically formed with a second thin film of silicon carbide (SiC) that is also deposited using PECVD.

Thus, the example passivation layer 210 differs from known passivation layers in at least two ways. First, different dielectric materials are used. In particular, the example passivation layer 210 is formed without a thin film of SiC layer but uses $HfO_2$ instead. Second, the deposition technique used to apply the materials is different. In particular, rather than applying the $HfO_2$ using PECVD, as is done for the SiC in known passivation layers, the $HfO_2$ thin film 216 of the example passivation layer 210 is formed using ALD. These two differences from known passivation layers in printheads result in a number of significant advantages. For example, these differences provide stronger dielectric properties achieved with a thinner film stack, which may result in improved energy and/or thermal efficiency, smaller sized printheads and/or greater nozzle density, lower costs, and faster print speeds.

Testing has shown that the example passivation layer 210 formed using the hybrid passivation approach disclosed herein can be much thinner than other known passivation layers while still meeting required electrical specifications. For example, as noted above, using exclusively PECVD to deposit thin films of SiN and SiC as is done for many existing printheads, the passivation layer typically has a thickness of approximately 2500 angstroms (with approximately 1670 Å corresponding to SiN and 830 Å corresponding to SIC). By contrast, the passivation layer 210 based on a PECVD/ALD hybrid passivation of SiN and $HfO_2$ can have a total thickness of less than 1500 angstroms with some applications successfully manufactured at thickness considerably less. That is, in some examples, the passivation layer 210 has a total thickness of approximately 1000 angstroms or less. In some examples, the passivation layer 210 has a total thickness of approximately 500 angstroms or less. It is expected that passivation layers as thin as 300 angstroms may successfully be manufactured while still satisfying typical printing application design specifications.

As apparent from the example thicknesses for the passivation layer 210 made possible by implementing the teachings of this disclosure, the thickness of both the SiN thin film 214 and the $HfO_2$ thin film 216 may be significantly thinner than the corresponding SiN/SiC thin film layer in known passivation layers. For instance, in some examples, the $HfO_2$ thin film 216 has a thickness of approximately 200 Å. In some examples, the $HfO_2$ thin film 216 has a thickness as low as approximately 50 Å, which is a significant reduction in thickness relative to the 830 Å of SiC. While the ALD procedure enables protective films of $HfO_2$ that are much thinner than films of SiC in comparable passivation layers of known printheads, the use of $HfO_2$ deposited using ALD also enables a reduction in the required thickness of the SiN thin film. For example, whereas the SiN thin film layer of known passivation layers in printheads is typically over 1600 Å, when the $HfO_2$ thin film 216 is used as disclosed herein, the thickness of the SiN thin film 214 can be reduced to a range between approximately 250 Å and 1200 Å while maintaining similar levels of protection and electrical properties for the passivation layer 210.

At least part of the reason that the example passivation layer 210 of the illustrated example is so much thinner than other known passivation layers for printheads is because the implementation of ALD provides for better step coverage than PECVD. Step coverage, also known as shadowing, refers to the level of uniformity of thickness of a thin film deposited on a surface that is non-planar or three-dimensional (e.g., includes a step or other irregularity). For example, the close-up view in FIG. 2 shows an angled portion 218 along the edge of the conductor layer 213 between two flat portions 220, 222. As shown in the illustrated example, a thickness 224 of the SiN thin film 214 on the flat portion 220 is greater than a thickness 226 of the SiN thin film 214 on the angled portion 218 indicating relatively poor step coverage (due to the PECVD process used to deposit the SiN thin film 214). By contrast, as illustrated in FIG. 2, a thickness 228 of the $HfO_2$ thin film 216 on the flat portion 220 is approximately equal to a thickness 230 of the $HfO_2$ thin film 216 on the angled portion 218 indicating relatively good step coverage (due to the ALD process used to deposit the $HfO_2$ thin film 216).

More generally, step coverage can be quantified as the ratio between the thickness of a thin film at the bottom side of a vertical wall or step and the thickness of the film at the top of the step. In some example printheads, the step coverage (expressed as a percentage) for PECVD is approximately 50% whereas the step coverage for ALD is approximately 100%. In some examples, the step coverage for ALD is greater than 95%. In some examples, the step coverage for ALD ranges from 80% to 100%. With less than 100% step coverage, as is the case for PECVD, angled portions (such as the angled portion 218) and/or other irregularly shaped surfaces become potential points of weakness for a passivation layer such that the total thickness of the passivation layer at other regions must be increased above what would otherwise be needed. Thus, existing passivation layers for printheads that are manufactured using exclusively PECVD (with relatively poor step coverage) need to be thicker overall to compensate for and provide adequate protection of the irregularly shaped sections of the printhead surface. By contrast, the example passivation layer 210 of FIG. 2 includes the $HfO_2$ thin film 216 deposited using ALD (with nearly perfect step coverage) for consistent protection at all points along the surface of the substrate 202 allowing for a thinner film overall.

Another limitation of PECVD overcome by ALD is the presence of pinhole defects in the deposited thin film. While the particular density of pinhole defects in a PECVD thin film can vary depending upon the conditions and parameters of the process, there is typically a nontrivial amount of defects. As a result, the thickness of the thin film layers fabricating using PECVD may need to be increased to reduce the negative effects of pinhole defects such as, for example, stress points or corrosion paths through the film. By contrast, the procedure of ALD enables the deposition of thin films that are free of pinhole defects (e.g., the defect density is zero or at least so low as to be negligible) such that the thickness can be much less than necessary for a PECVD applied film to achieve the same properties and level of protection for surfaces underneath the deposited film. In addition to enabling the $HfO_2$ thin film 216 to be thinner because there is no concern for defects, the pinhole-free characteristic of the $HfO_2$ thin film 216 of the example passivation layer 210 also results in less concern of any defects in the SiN thin film 214 becoming exposed to the external environment such that the SiN thin film 214 can be much thinner as well even though still applied using PECVD.

There are a number of advantages or benefits achieved with the thinner passivation layer 210 (with a thickness ranging between approximately 300 Å and 1500 Å) as compared to known passivation layers (with a thickness of approximately 2500 Å). For example, a thinner passivation layer enables the overall size of a printhead to be smaller while maintaining the same dimensions for the vias 208 and other channels through which ink is to pass. Furthermore, as discussed more fully below, a thinner passivation layer allows for a reduction in the turn-on energy (e.g., the energy needed to eject a stable ink drop), thereby allowing for a smaller power device in the printhead providing the needed electrical power. As a result, a greater number (e.g., approximately an 8% increase) of printheads may be fabricated on a single silicon wafer, thereby reducing the cost of production.

Furthermore, the passivation layer 210 increases the energy and thermal efficiency of the printhead over known printheads because the reduced thickness improves heat transfer from the ejection actuator 209 (e.g., a heat resistor) to the ink. Further, the thinner passivation layer 210 enables a reduction of the maximum temperature needed to eject ink through the nozzles 106. For example, thermal modeling of known printheads with passivation layers of SiN/SiC of 2500 angstroms thick indicate temperatures of the film stack reaching approximately 4731 for stable ink drop ejection. By contrast, the example printhead 104 of FIG. 2 with a 1000 angstrom thick passivation layer (e.g., 800 Å of SiN and 200 Å of $HfO_2$) may achieve stable ink drop ejection at maximum temperatures of less than 400° C. (e.g., below 370° C.). In some examples, the lower temperatures and improved heat transfer due to the thinner passivation layer 210 results in a reduction (as much as 7%) in the turn-on voltage (e.g., the voltage needed to fire an ink drop). Additionally, or alternatively, in some examples, the lower temperatures and improved heat transfer due to the thinner passivation layer 210 results in a reduction (as much as 9%) in the current applied to the ejection actuator 209. Furthermore, the reduced voltage and/or current used in the printhead 104 may reduce the cost and/or increase the efficiency of other components in the printer 100 that provide the power to the printhead 104.

Additionally, the reduced thickness of the example passivation layer 210 can increase the firing frequency of printhead 104 resulting in the potential for increased printing speeds. In particular, the firing frequency is limited by the maximum temperature needed to eject ink from the nozzles 106 because the ink must be cooled after a fire pulse before another fire pulse can be initiated. With the lower temperatures used to eject ink, there will be less time needed for the ink to cool such that the firing frequency may be increased. Also, just as ink takes less time to cool when its maximum temperature is lower, the ink can be heated to the needed temperature for stable ink ejection in a shorter amount of time further improving the firing frequency.

Figure 3:
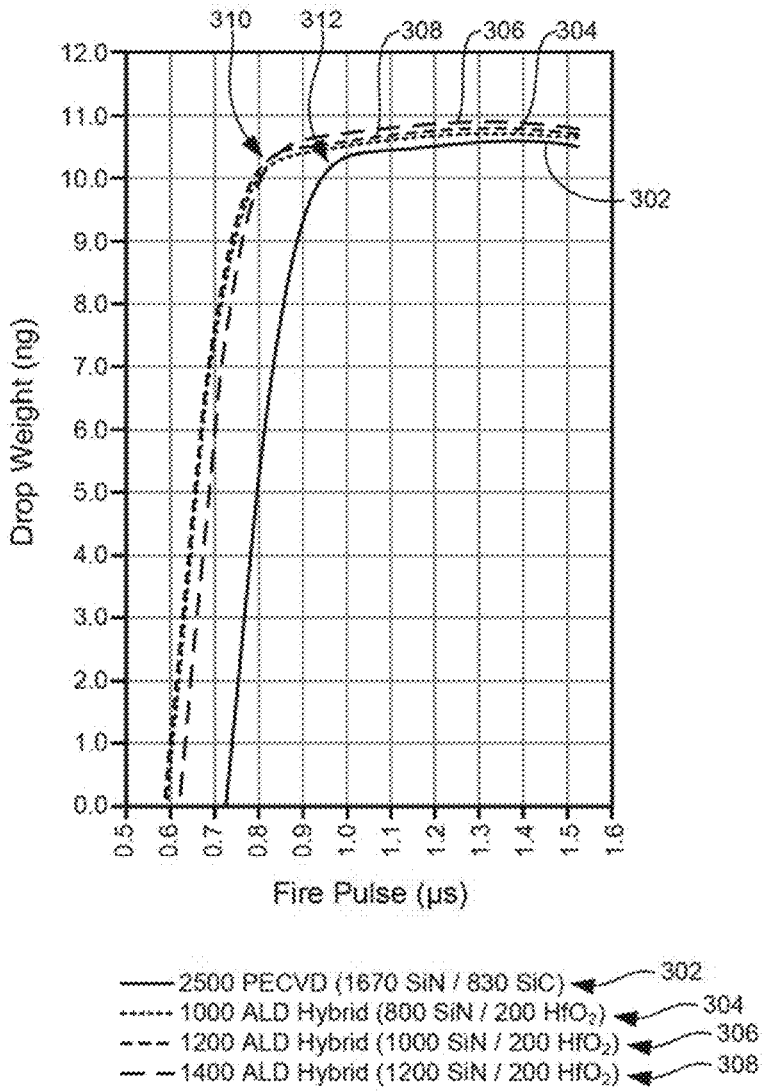
FIG. 3 is a graph showing the lines of best fit for the measured values of fire pulses for printheads with different passivation layers, some of which are fabricated in accordance with the teachings of this disclosure.

Furthermore, the reduced amount of time to heat the ink indicates a reduced amount of time that power must be applied to the ejection actuator 209 (e.g., a heat resistor), thereby making the printhead 104 more energy efficient. The amount of energy used to fire ink through a nozzle is referred to as the turn-on energy and is proportional to the duration of a fire pulse (e.g., the time it takes fire ink after the ejection actuator 209 is initially energized). FIG. 3 is a graph showing the lines of best fit for measured values of fire pulses for printheads having different passivation layers. As shown in FIG. 3, the horizontal axis represents the fire pulse or the amount of time (measured in microseconds) that an ejection actuator 209 is energized before ink is ejected from a nozzle 106. The vertical axis in the chart of FIG. 3 represents the weight of an ink drop that is ejected from the nozzle after a fire pulse. As shown in FIG. 3, smaller ink drops (of lower weight) typically fire faster than larger ink drops.

In the example chart of FIG. 3, the solid line represents typical fire pulses measured for ink fired from a sample printhead with a known PECVD passivation layer 302 formed with SiN and SiC using exclusively PECVD. The three broken lines in the graph of FIG. 3 illustrate typical fire pulses measured for ink fired from sample printheads with example ALD hybrid passivation layers 304, 306, 308 fabricated similarly to the passivation layer 210 of FIG. 2 with a SiN thin film 214 formed using PECVD and an $HfO_2$ thin film 216 formed using ALD. As shown in FIG. 3, the $HfO_2$ thin film 216 of each of the ALD hybrid passivation layers 304, 306, 308 is the same thickness (200 Å) but the SiN thin film 214 changes from 800 Å to 1000 Å to 1200 Å, respectively, for each of the three ALD hybrid passivation layers 304, 306, 308.

As shown in the graph of FIG. 3, the fire pulse for each of the ALD hybrid passivation layers 304, 306, 308 can be as short as approximately 0.6 microseconds (for ink drop weights approaching 0 nanograms (ng)) and approximately 0.82 microseconds for stable ink drop ejection (beginning at the knee 310). By contrast, the fire pulse for low-weight ink drops from a printhead with the known PECVD passivation layer 302 is approximately 0.72 microseconds with stable ink drop ejection beginning at approximately 0.96 microseconds. Inasmuch as turn-on energy is proportional to fire pulse, comparing these measured fire pulses indicates that the ALD hybrid passivation layers 304, 306, 308 reduce the turn-on energy by approximately 15% for the particular printing application tested. In the particular samples tested to generate the graph of FIG. 3, in addition to the SiN thin film 214 and the $HfO_2$ thin film 216, the passivation layer also included a thin film of tantalum (Ta). It is expected that even greater increases in turn-on energy may be achieved with a thinner Ta layer.

While the above advantages and improvements of the example printhead 104 of FIG. 2 over other known printheads are achieved in part due to the reduced thickness of the passivation layer 210, the materials used in the passivation layer 210 also play a role in increasing the energy efficiency of the example printhead 104. In particular, the $HfO_2$ thin film 216 of the passivation layer 210 increases the efficiency of the example printhead 104 because $HfO_2$ exhibits stronger dielectric properties than SiC that is used in other known passivation layers. That is, there is less energy loss through the passivation layer 210 of FIG. 2 than occurs through passivation layers in existing printheads. Furthermore, this property may play a role in the reduction of the thickness of the SiN thin film 214 because the electrical load supported by the passivation layer 210 may be shared between the SiN film and the $HfO_2$ film rather than primarily relying on the SiN film layer. The improvement in dielectric properties of the example passivation layer 210 of FIG. 2 is illustrated in the graphs of FIGS. 4 and 5.

Figure 4:
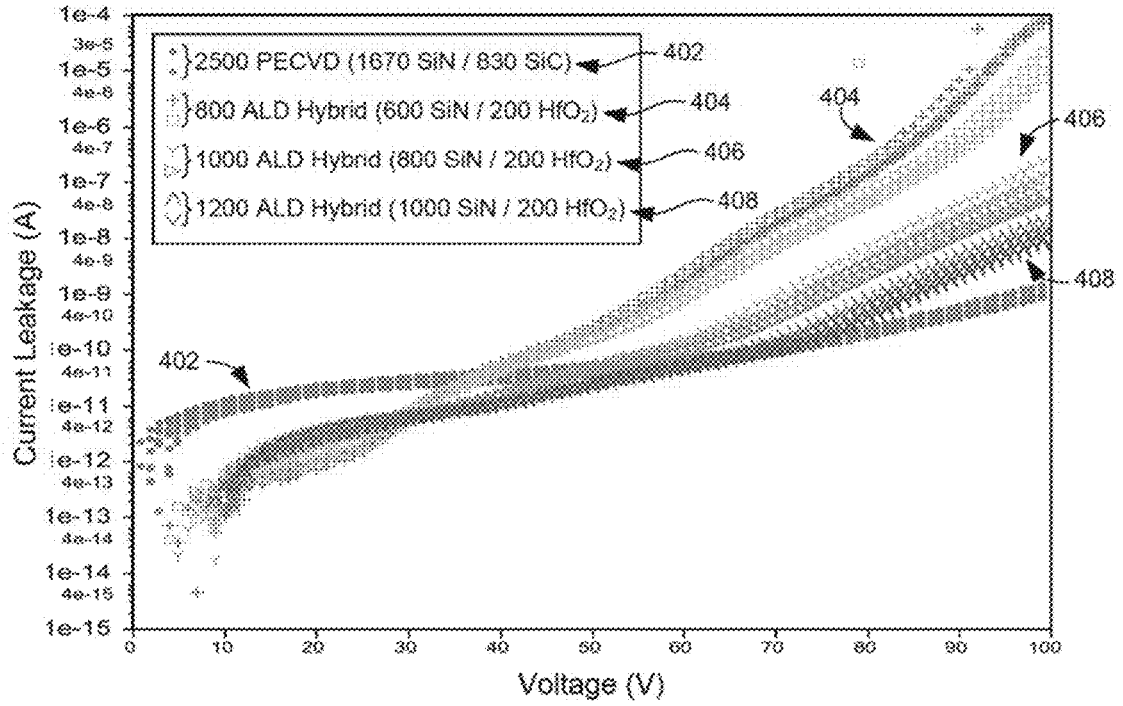
FIGS. 4-5 are graphs representing the electrical leakage measured for printheads with different passivation layers, some of which are fabricated in accordance with the teachings of this disclosure.

FIG. 4 is a graph representing the electrical leakage measured for printheads having different passivation layers operating between 0 and 100 volts. More particularly, the graph of FIG. 4 represents the measured electrical leakage from sample printheads with known PECVD passivation layers 402 formed with SiN and SiC using exclusively PECVD. Additionally, FIG. 4 represents the measured electrical leakage from sample printheads with example ALD hybrid passivation layers 404, 406, 408 fabricated similarly to the passivation layer 210 of FIG. 2 with a SiN thin film 214 formed using PECVD and an $HfO_2$ thin film 216 formed using ALD. As shown in FIG. 4, the $HfO_2$ thin film 216 of each of the ALD hybrid passivation layers 404, 406, 408 is the same thickness (200 Å) but the SiN thin film 214 changes from 600 Å to 800 Å to 1000 Å, respectively, for each of the three ALD hybrid passivation layers 404, 406, 408.

As shown in FIG. 4, each of the ALD hybrid passivation layers 404, 406, 408 exhibit an electrical leakage that is less than or equal to the known PECVD passivation layers 402 at voltages less than approximately 40 V. The operating range for many printheads is between approximately 28 V and 33 V. Thus, across the expected operational range of most printers, example printheads manufactured in accordance with the teachings of this disclosure will reduce energy losses relative to known printheads.

Figure 5:
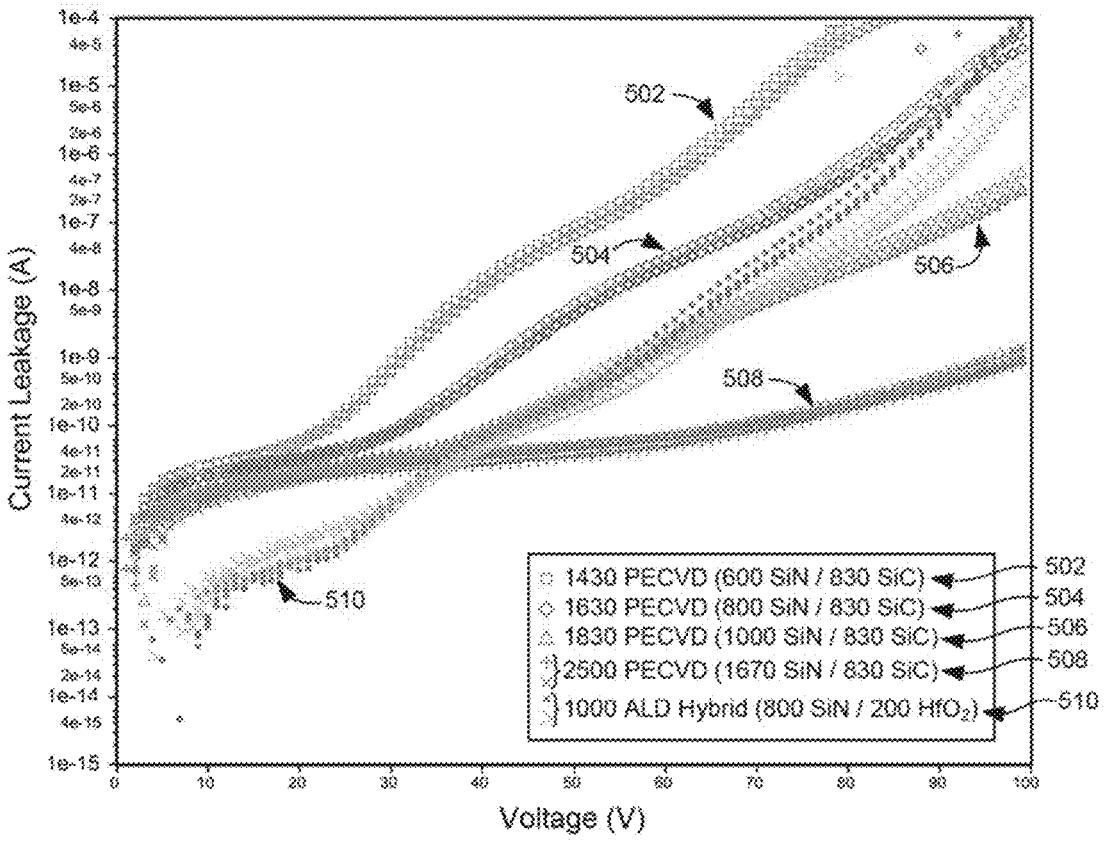

FIG. 5 is a graph similar to FIG. 4 but representing the measured electrical leakage from sample printheads with known PECVD passivation layers 502, 504, 506, 508 having different thickness of the SiN thin film layer ranging between 600 Å and 1670 Å. FIG. 5 also represents the measured electrical leakage from same printheads with example ALD hybrid passivation layers 510 manufactured in accordance with the teachings of this disclosure. In the example graph of FIG. 5, the sample printheads with the known PECVD passivation layers 508 with a total thickness of 2500 Å correspond to the sample printheads with the PECVD passivation layers 402 represented in the graph of FIG. 4. Similarly, the sample printheads with the ALD hybrid passivation layers 510 of FIG. 5 correspond to the sample printheads with the ALD hybrid passivation layers 406 of FIG. 4. As shown in FIG. 5, the different thicknesses of the known PECVD passivation layers 502, 504 506, 508 all experience electric leakage greater than the ALD hybrid in the expected operating range of printheads below 40 V. Furthermore, the ALD hybrid passivation layers 510 have the same thickness of SiN as the known PECVD passivation layer 506. Comparing these two passivation layers (with the same SiN thin film thickness) indicates that the electric leakage of the ALD hybrid passivation layer 510 remains less than or equal to that of the PECVD passivation layer 506 up to approximately 65 V.

Figure 6:
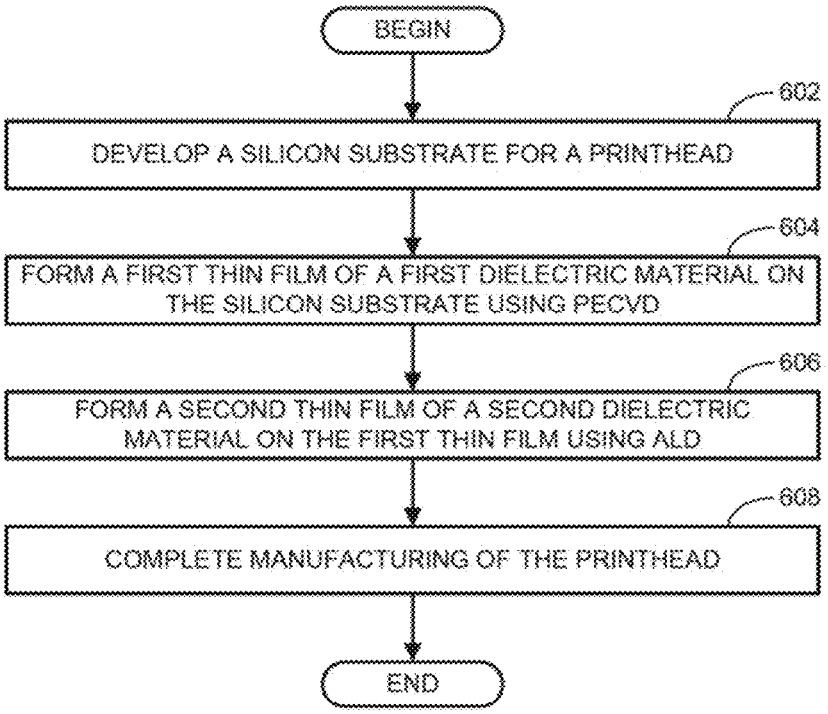
FIG. 6 is a flowchart illustrating an example method of manufacturing the example printhead of FIGS. 1 and/or 2.

FIG. 6 is a flowchart illustrating an example method of manufacturing the example printhead of FIGS. 1 and/or 2. Beginning at block 602, the example process includes developing a silicon substrate (e.g., the silicon substrate 202 of FIG. 2) for a printhead (e.g., the printhead 104). At block 604, the example process includes forming a first thin film of a first dielectric material on the silicon substrate 202 using PECVD. In some examples, the first dielectric material is SiN. At block 606, the example process includes forming a second thin film of a second dielectric material on the first thin film using ALD. In some examples, the second dielectric material is $HfO_2$. At block 608, the example process includes completing the manufacturing of the printhead 104, whereupon the example process of FIG. 6 ends.

The example printheads (and associated methods) that include the passivation layer 210 of FIG. 2 formed of a thin film stack of SiN and $HfO_2$ using a hybrid of PECVD and ALD techniques disclosed herein are based on tradeoffs between the dielectric properties, chemical robustness, and the methods of deposition of the materials involved to achieve cost effective, energy efficient, and reliable printheads that meet desired specifications. As such, the particular thicknesses of the thin film layers, the materials used, and/or the methods of depositing such materials may vary with changes in the application and associated requirements. For example, the above examples have been described with respect to a thermal inkjet printer where the ink is repeatedly heated and cooled. However, piezoelectric printheads are subject to different stresses such that the thicknesses, materials, and/or arrangement of the thin film layers for example piezoelectric printheads may be suitably adapted.

In some examples, rather than using the hybrid passivation approach described above, both the SiN thin film 214 and the $HfO_2$ thin film 216 of the passivation layer 210 may be applied using ALD. Currently, the application of SiN using ALD is not a viable option as being cost prohibitive and difficult to accomplish successfully, which is why PECVD is used in the illustrated example. However, as further research is performed and the ALD technique is developed, it is anticipated that using exclusively ALD procedures (e.g., for both the SiN and $HfO_2$) may allow for passivation layers with even smaller thicknesses while maintaining the same levels of robustness and electrical properties. Similarly, as the technology advances, it is expected that a thin film layer of SiC may be applied using ALD to provide better step coverage and no pinhole defects than currently known passivation layers without using $HfO_2$. However, this approach is currently not a viable option and involves the tradeoff of providing less dielectric strength than would be provided by $HfO_2$.

In still other examples, the passivation layer may be formed exclusively from a thin film of $HfO_2$ without a thin film layer of SiN as $HfO_2$ provides both strong dielectric properties and chemical robustness. However, such examples involve a tradeoff in that current ALD procedures are much slower than PECVD, thereby increasing costs. Furthermore, a single layer of $HfO_2$ without the SiN thin film can introduce greater mechanical stresses.

From the foregoing, it will be appreciate that the above disclosed methods, apparatus and articles of manufacture enable the production of printheads that are more energy efficient than is currently possible using existing methods. More particularly, the use of ALD instead of PECVD to apply thin films to a silicon substrate improves step coverage and results in a pinhole-free film. These characteristics make enable a thinner passivation layer that maintains the desired robustness as other known passivation layers. The thinner passivation layer improves heat transfer across the passivation layer enabling ink ejection at lower temperatures, with reduced voltage and/or current, at higher frequencies. Furthermore, the use of $HfO_2$ instead of SiC improves the dielectric properties of the passivation layer further improving the energy efficiency.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A printhead comprising:

a substrate with channels to direct ink toward a plurality of nozzles of the printhead; and a passivation layer on the substrate, the passivation layer including a first thin film of a first dielectric material and a second thin film of a second dielectric material, wherein the first thin film is in direct contact with the second thin film.

2. The printhead of claim 1, wherein a thickness of the passivation layer is less than or equal to 1500 angstroms.

3. The printhead of claim 1, wherein a thickness of the first thin film is less than or equal to 200 angstroms.

4. The printhead of claim 1, wherein the second dielectric material is silicon mononitride.

5. The printhead of claim 4, wherein the first dielectric material is hafnium oxide.

6. The printhead of claim 1, wherein the second thin film is disposed between the substrate and the first thin film.

7. A printhead, comprising:

a substrate to direct ink to nozzles in the printhead to eject the ink; and a passivation layer to protect the substrate, the passivation layer including:

a first thin film of a first dielectric material on the substrate having a step coverage greater than or equal to 80%.

8. The printhead of claim 7, wherein the first thin film is free of pinhole defects.

9. The printhead of claim 7, wherein a thickness of the passivation layer is less than or equal to 500 angstroms.

10. The printhead of claim 7, wherein the first thin film corresponds to hafnium oxide formed on the substrate using atomic layer deposition.

11. The printhead of claim 7, wherein the passivation layer further includes a second thin film of a second dielectric material that is disposed between the substrate and the first thin film, and wherein the first and second thin films are in direct contact with each other.

12. A method, comprising:

forming a first thin film of a first dielectric material on a substrate having channels to direct ink toward a plurality of nozzles of a printhead, wherein the first thin film is formed using atomic layer deposition; and forming a second thin film of a second dielectric material on the first thin film using plasma-enhanced chemical vapor deposition, wherein the first and second thin films are in direct contact.

13. The method of claim 12, wherein forming the first thin film includes depositing the first dielectric material on the substrate with a step coverage greater than or equal to 80%.

14. The method of claim 12, wherein the first thin film and the second thin film collectively form a passivation layer that spans a width of the printhead, and wherein forming the first thin film and the second thin film includes depositing the first thin film and the second thin film over the width of the passivation layer.

15. The method of claim 12, wherein the first thin film and the second thin film collectively form a passivation layer that spans a width of the printhead, and wherein forming the first thin film and the second thin film includes depositing the first thin film and the second thin film to a combined thickness between approximately 300 angstroms and approximately 1000 angstroms.

16. The method of claim 12, wherein forming the second thin film includes depositing the second dielectric to a thickness between approximately 50 angstroms and approximately 200 angstroms.

17. The method of claim 12, wherein the first thin film and the second thin film collectively form a passivation layer that spans a width of the printhead, and wherein forming the first thin film and the second thin film includes depositing the first thin film and the second thin film to a combined thickness of less than or equal to 500 angstroms.

18. The method of claim 12, wherein forming the first thin film includes depositing hafnium oxide on the substrate using atomic layer deposition.

19. The method of claim 12, wherein forming the second thin film includes depositing silicon mononitride on the substrate using plasma enhanced plasma-enhanced chemical vapor deposition.

* * * * *